US006106445A

United States Patent [19]

Lay

[11] Patent Number: 6,106,445

[45] Date of Patent: Aug. 22, 2000

[54] ERGONOMIC, PASSIVE EXERCISE CHAIR WITH PASSIVE EXERCISE HEADREST

[76] Inventor: Kenneth G. Lay, P.O. Box 800, Edgartown, Mass. 02539

[21] Appl. No.: 09/375,128

[22] Filed: Aug. 16, 1999

Related U.S. Application Data

[63] Continuation-in-part of application No. 08/684,579, Jul. 19, 1996, abandoned.

[51] Int. Cl.[7] ..... A63B 26/00

[52] U.S. Cl. ..... 482/142; 482/148; 601/115

[58] Field of Search ..... 482/79, 904, 142, 482/10, 132, 136, 137, 148, 41, 145; 601/105, 115, 116, 117, 118, 122, 126, 127, 128; 297/400, 391

[56] References Cited

U.S. PATENT DOCUMENTS

| | | | |
|---|---|---|---|
| 1,129,802 | 2/1915 | Hoard | 601/115 |
| 2,259,551 | 10/1941 | Burke | 601/118 |
| 5,242,342 | 9/1993 | Silverman | 482/79 |
| 5,411,456 | 5/1995 | Lay | 482/79 |
| 5,540,643 | 7/1996 | Fontaine | 482/904 |
| 5,576,085 | 7/1998 | Stone et al. | 601/99 |
| 5,643,182 | 7/1997 | Engel | 601/122 |
| 5,743,832 | 4/1998 | Sands et al. | 482/142 |

*Primary Examiner*—Stephen R. Crow
*Attorney, Agent, or Firm*—Perkins, Smith&Cohen, LLP; Jerry Cohen

[57] ABSTRACT

An ergonomic, passive exercise apparatus with elements and attachments emphasizing benefits to the user's head, neck and back muscles. The apparatus is a chair to which an adjustable dual roller headrest is joined. The headrest is adjustable vertically, laterally, with each roller virtually independent of position and orientation with respect to the other. Adjustable drag to rotation and lateral movement is provided for the user to work against while exercising. in addition, removable, location adjustable pairs of disks may be attached to the axles or rollers. The disks extend outward from the rollers to engage the back of the user's head. The disks are of a resilient material and resist rotation of the user's head when in contact with the disks.

4 Claims, 5 Drawing Sheets

ERGONOMIC, PASSIVE EXERCISE CHAIR WITH PASSIVE EXERCISE HEADREST

RELATED APPLICATIONS

This application is a continuation-in-part application of a U.S. continuing prosecution application Ser. No. 08/684,579 filed on Aug. 21, 1998. U.S. application Ser. No. 08/684,579 now abandoned was first filed on Jul. 19, 1996. The present application claims priority under 35 U.S.C. 119(e) on the Provisional Application filed on Jul. 20, 1995, of common inventorship. The present invention is also related to U.S. Pat. No. 5,411,456, granted May 2, 1995 of common inventorship with the present invention, and that patent is incorporated herein by reference as if laid out in full herein.

FIELD OF THE INVENTION

The present invention is related to the field of exercise apparatus and methods, and more specifically to passive exercise apparatus and methods, and even more particularly to a passive, exercise headrest attached to the back of an exercise chair.

BACKGROUND OF THE INVENTION

It is a known in the art that extended periods of sitting cause the body to weaken. However, through a correct method of positioning the body, one can actually strengthen and re-align rather than weaken the body while sitting.

Micro-movements, e.g. small movements, used by ergonomic and human factor professionals, are those motions of an individual continually adjusting his body position while seated. With every adjustment, regardless how subtle, a weight transference occurs.

It is an object of the present invention to provide benefits and advantages of passive exercise for any individual by making virtually all elements of the exercise apparatus adjustable in position and in resistance to movements. The present invention encourages the center of gravity of the body to move to a position for providing maximum mechanical advantage for substantially any activity.

It is another object of the present invention to improve muscle coordination thereby allowing ease and comfort of motion.

It is yet another object of the present invention to provide an adjustable headrest that allows passive exercise of the head, neck and adjacent muscles.

It is still another object of the present invention to capture micro-movements and weight transfers to the benefit of the user.

SUMMARY OF THE INVENTION

The objects set forth above as well as further and other objects and advantages of the present invention are achieved by the embodiments of the invention described herein below.

The inventive passive exercise apparatus has a frame including an adjustable back support member with means for adjusting the vertical angle of the back support from upright to horizontal. There are two adjustable back cushions arranged transverse to the back of a user with means for adjusting and fixing the position of each cushion with respect to each other and with respect to the back of a user. The chair includes a seat resting on a support plate attached to the frame. The seat is arranged to tip and/or to rotate via a rotating connecting means to the support plate extending from the bottom surface of the seat. Additionally, there are means for creating drag that impedes the rotation of the seat.

A headrest is adjustably attached to the back support member at the head height of a seated user. The headrest is arranged with a first roller defining a first cylindrical axis substantially perpendicular to the axis of the user's backbone, and a second roller defining a second cylindrical axis substantially parallel and positioned lower than said first roller. The rollers are slidably mounted on axles and drag is provided that impedes the rotation of the rollers. The rollers are arranged to receive the back of the user's head. The distance between the rollers is adjustable, and adjustable means are provided for creating drag that impedes the rotation of the rollers. Also, the distance from the headrest to the frame is adjustable to fit the user.

A pair of resilient disk may be removably and position adjustably attached to each axle or to each roller. The disks extend outward radially from the axles and are arranged to accept the back of the user's head. The resilient disks resist rotation of the user's head in contact with the disks. The disks in other preferred embodiments may be of different diameters and be attached by belts or by other known apparatuses.

Adjustable pommel handles, leg restraints and supports and a footrest are provided to accommodate the user.

Other objects, features and advantages will be apparent from the following detailed description of preferred embodiments thereof taken in conjunction with the accompanying drawings.

PREFERRED EMBODIMENTS OF THE PRESENT INVENTION

The present invention provides means for capturing the micro movements of the body and organizing the user's muscle system by placing the body in specific positions. The specific positions are designed to recognize that some parts of the human body, depending on the position, lack enough support to allow movements, and that other parts of the body need restraint or resistance in order to be strengthened. The present invention focuses on restraint and support for the user's head for initiating muscle activity.

Figure 1:
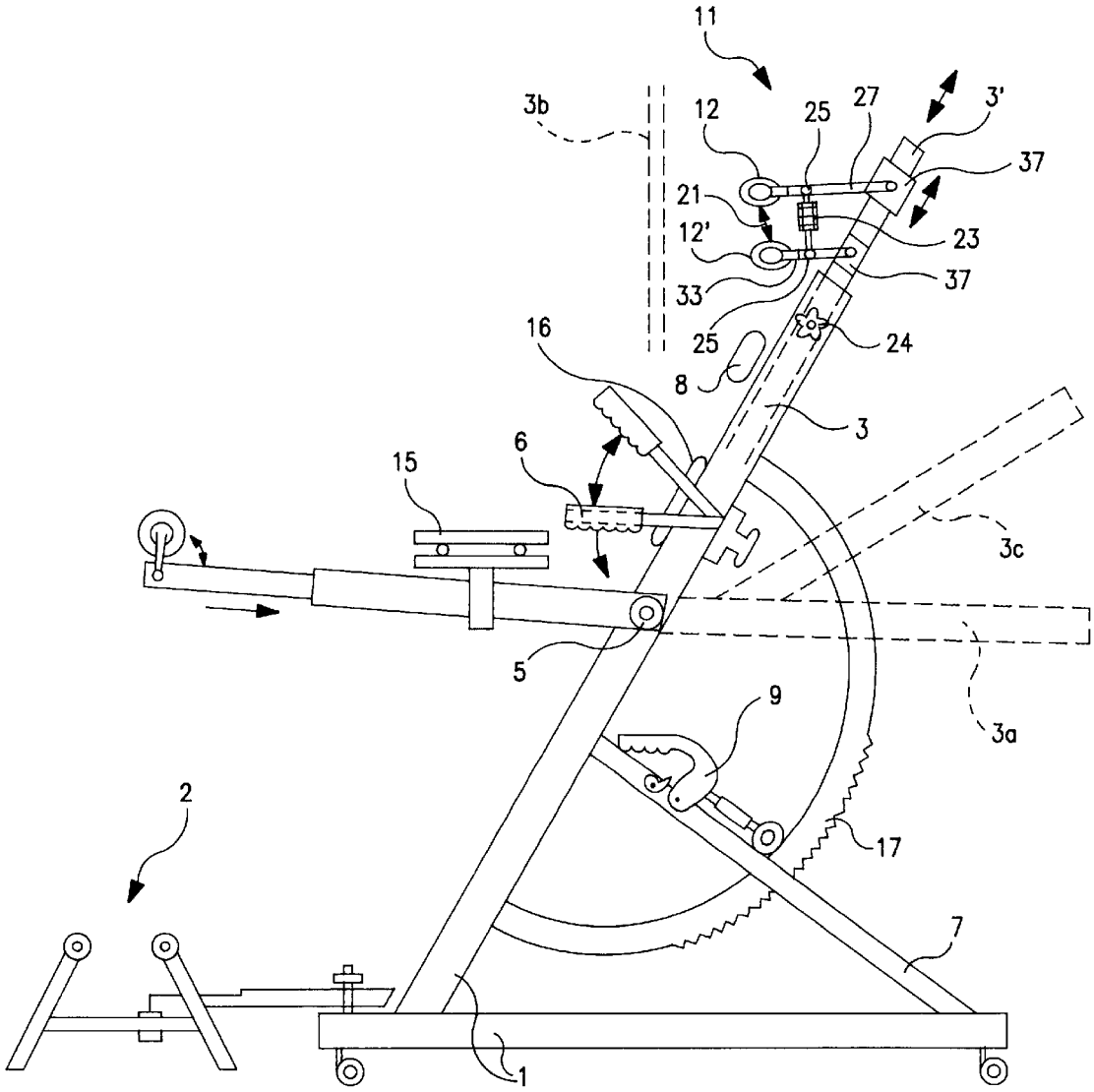
FIG.1 is a side view of the exercise chair.

FIG. 1 shows the entire chair with many individual elements attached. There is a frame 1 made up of a back support member 3 with a pivot joint 5 that allows the back support member to lie flat 3*a* or vertical 3*b* or at any in between angle represented by 3*c*. A wheel gear 17 fixed to the bottom 7 of the frame supports the back support member to allow angular positioning of the back support member. A hand crank 9 mechanism turns the wheel gear and pins may be used to secure the back support member at the desired angle. Such devices are well known in the exercise apparatus field.

Still referring to FIG. 1, attached to the back support member are adjustable transverse back cushions 8 and 16, adjustable hip handles 6, a rotatable, tippable seat 15 with built in adjustable drag to rotation, and a passive exercise foot rest 2. The hip handles 6 are provided at near hip level with grips suitable for supporting the user. The handles are adjustable so that the handles may rotate plus or minus forty-five degrees (45°) as shown. The back cushion 16 is placed near the handles for comfort and support of the user.

Figure 2A:
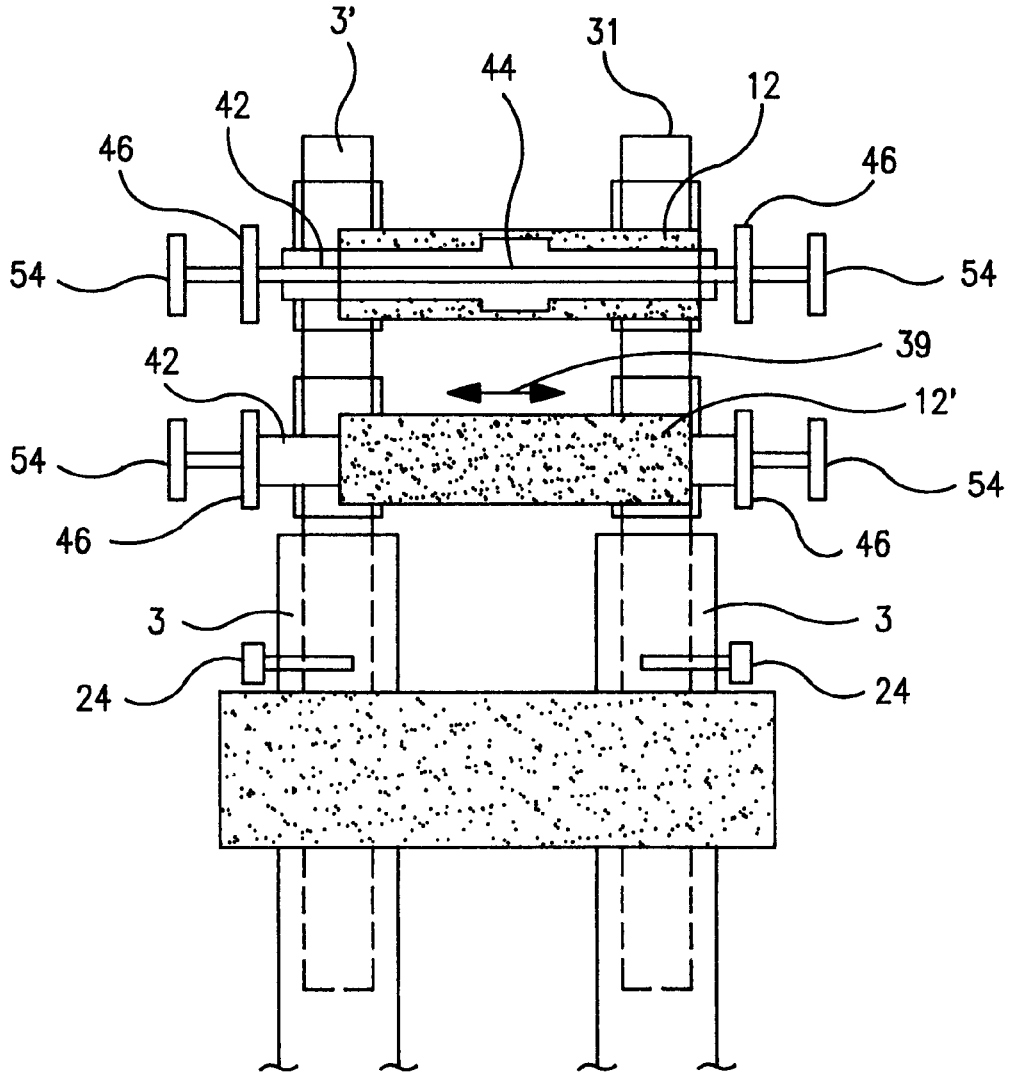
FIG. 2A is a more detailed view of the front view of the headrest.

Still referring to FIG. 1, there are adjustable dual rollers 12 and 12' provided as a headrest for the user. FIG. 2A shows a front view of the rollers 12 and 12' with lateral adjustability 39. The rollers are shown offset to the right of the drawing. In FIG. 2A a more detailed front view of the rollers show pin mechanisms 24 that allow the frame members 3' to telescope into and out of the frame members 3 thereby providing vertical adjustability of the headrest to accommodate the user's head. The distance between the rollers 21 is controlled by the hand-rotated extensions or turnbuckles 23 that are shown in more detail in FIG. 3B. Here two tapped axles 60 and 62 are threaded into a body of the turnbuckle 64. The body 64 has extensions 66 suitable for hand turning. Axle 60 has a right hand thread and axle 62 has a left hand thread. As shown if the turnbuckle rotates relative to the axles the axles will be drawn closer together or farther apart. In this manner the distance between the rollers can be selected. Other mechanisms can be used to advantage in place of the turnbuckles, for example, an internally threaded cylinder and a mating externally threaded axle that elongate or contract when rotated relative to each other.

Figure 3A:
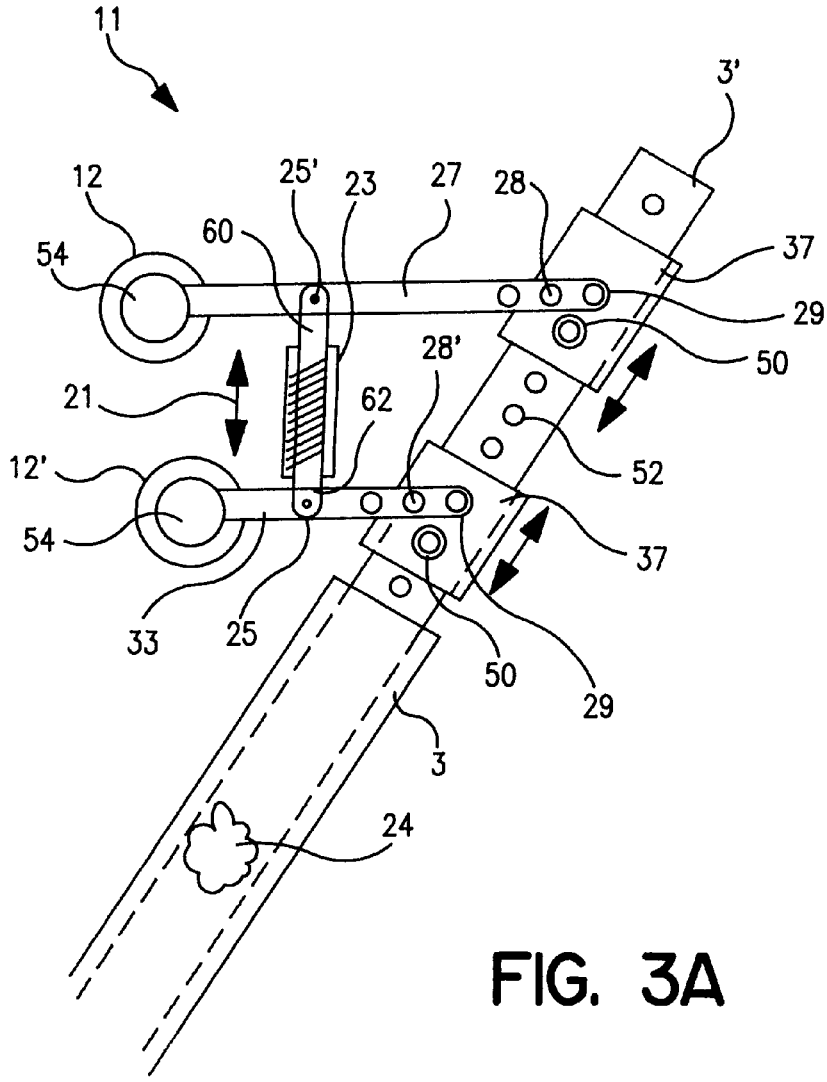
FIG. 3A is a side view of the headrest itself.
Figure 3B:
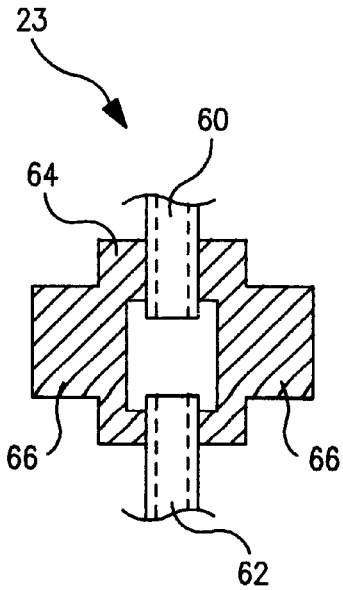
FIG. 3B is a detail of the adjustable turnbuckle of the headrest.

FIG. 3A is a side view of the headrest showing the vertical adjusting pins 24 and the dual rollers 12 and 12' that provide support for the head. The hand (only one shown) rotated turnbuckles 23 are pivotally attached 25 to the two upper supports 27 and to the two lower supports 33. The supports 27 and 33 are attached to the frame members 3' by four sleeves 37. The sleeves are fixed at locations determined by pins 50 running through the sleeves and the frame 3'. Holes 52 are provided for position adjustment along the frame. The turnbuckles 23 allow the spacing between and the vertical location to be freely adjustable. The supports 27 and 33 are pivotally attached to the sleeves 29. The rollers 12 and 12' move laterally 39 as shown by the arrow 39 in FIG. 2A. The rollers are slidably located on axles 40 and 42 and may be positioned laterally and then secured in those locations by known apparatus. For example, friction washers 54 that may be hand squeezed to release the friction between the washer and the axle. Using these washers, the rollers are positioned laterally whereupon the hand releasing tension causes the washer to engage and fix the roller to the axle. Other such for laterally positioning the rollers include (not shown) a pin extending through one of a series of holes (not shown) through the axles.

Figure 2B:
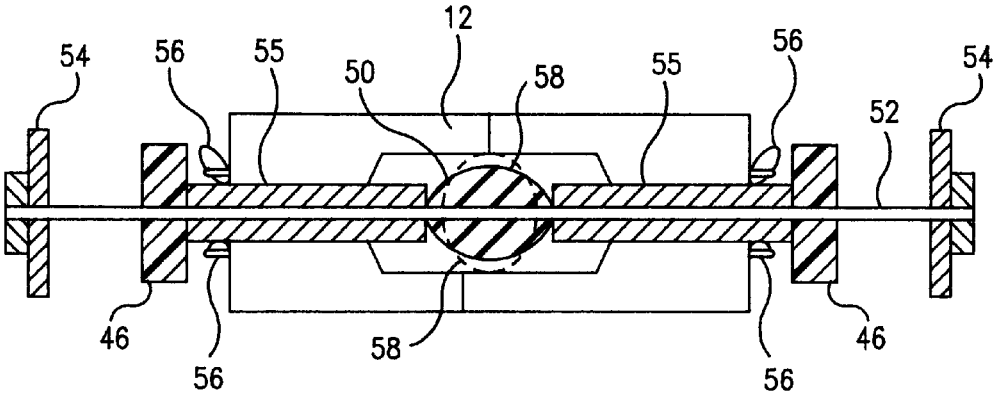
FIG. 2B is a cross section of the roller.
Figure 2C:
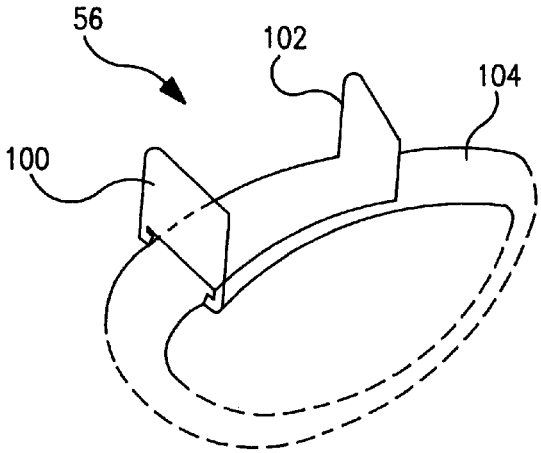
FIGS. 2C and 2D are details of a spring clip.
Figure 2D:
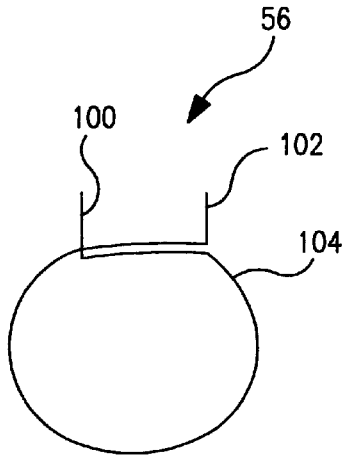

Referring to FIG. 2B, the adjustable drag or resistance to rotation constructed within each roller is shown in more detail in cross section. This drag is adjustable by hand operated knobs 46. The roller 12 is a cylinder rotationally resting on two other cylinders 55 located at each end of the roller. This rotational interface between the roller and the two cylinders may be constructed with ball bearings (not shown) or bushings of other such sliding mechanisms. There is an elastic or rubber ball 50 that is placed at the center of the roller, and the two cylinders 55 extend into the roller cavity until they contact the ball. There is a solid through axle 52 that is fixed to supports 54 at each end. This axle extends through the roller and the ball. The end supports 54 the axle are connected to the sleeves 37 (FIG. 1). The cylinders 55 are slidably mounted to the through axle. Plastic knobs 46 are provided for hand adjusting of the drag on the roller. The knobs are located on tapped sections of the through axle and the knobs are designed for hand turning. Rotating the knobs drives the cylinders 55 against the ball. The ball deforms and presses harder into the roller 58. By turning the knobs in the opposite direction the ball relaxes thereby decreasing the pressure on the roller, thus reducing the drag. In other preferred embodiments there may be several balls and the arrangements may differ. The rollers contact the back of the head on two points, and the motion of the head that tends to rotate the rollers does not traverse many degrees of rotation. The ball drag may be designed to slip or simply stretch, but in either case the more that the cylinders press against he ball, the harder the ball will press against the roller increasing drag. The mechanical design of the adjustable sleeves and pivoting joints includes the use of hinges, sliding surfaces, and apparatus to position the items and to secure the items at locations by use of through holes and pins or hand tightened screws that are commonly used in the design of exercise equipment. The headrest is geometrically interactive with the user's head by supporting the head as it presses backwards. The head support rollers allow lateral movements as well as rotational movement. Both up and down and left to right head motions while the head is pressing backwards provide exercise for the muscles in the back of the neck as well as the shoulder and the trapezes muscles. Spring clips 56 are provided to laterally position the roller. FIGS. 2C and 2D show the operation of typical spring clips. A spring steel band 104 is pre-formed into a circular shape. Two tabs 100 and 102 are for the user's fingers. Pressing the tabs toward each other works against the pre-formed shape spring action to enlarge the circle and allow the roller 12 to be positioned laterally as desired. Releasing the fingers allows the clips 56 to resume its pre-formed shape and thereby secured the roller at the position selected. Such clips and equivalents are well known in the art.

Figure 4:
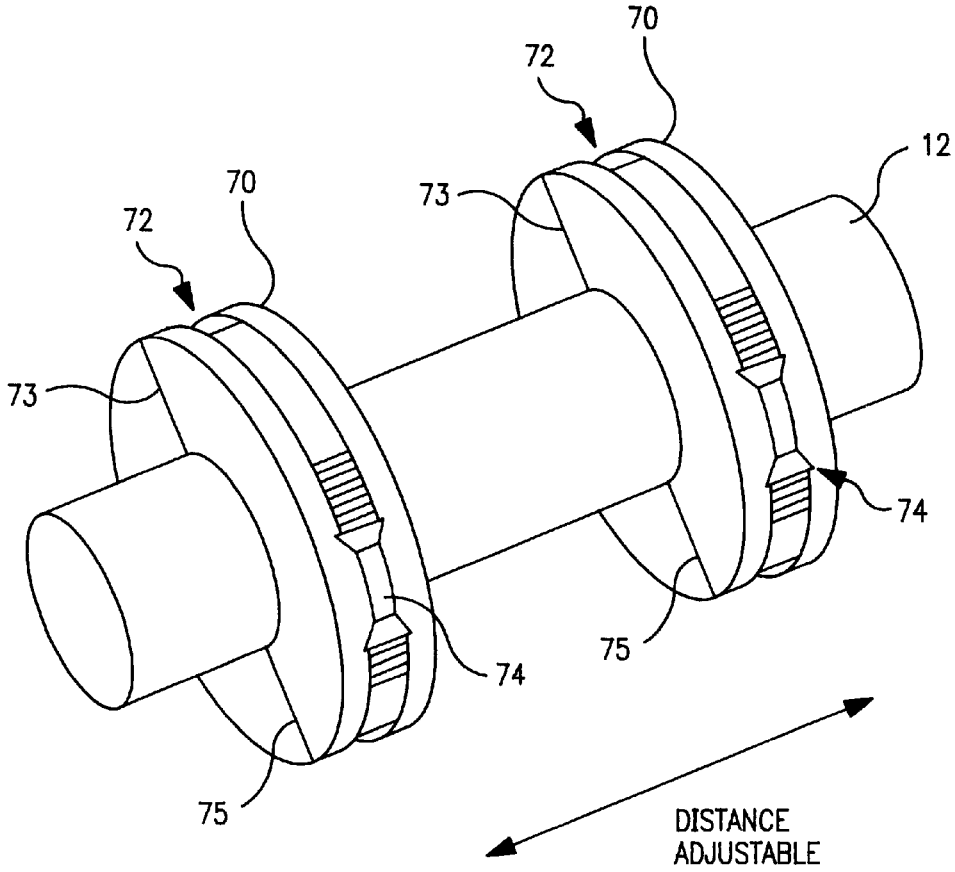
FIG. 4 is an isometric view of a roller with a pair of disks attached.

FIG. 4 shows another preferred embodiment with "donut" shaped, resilient rubber disks 70 positioned on a roller 12 to of engage the back of the user's head. These disks may be used on one or both rollers or on the axles without the rollers (not shown), and the diameters of the disks may be varied to accommodate the user and the types of exercise desired. The disks extend out from the surface of the roller 12 about 1.5 inches and the disk are about 1 inch thick. The groove 72 is formed around the periphery of each disk and an adjustable, releasable band 74 is arranged in the groove that can be tightened to secure the disks to the roller. By loosening the bands 74 the disks may be positioned along the roller to suit the user. The disks themselves may be made in two sections separated by the cuts 73 and 75 that extend through the disks. When the bands are loosened or removed the disks can be removed. In another preferred embodiment there may be only one cut 73. In this case the cut 73 may be opened enough to allow the disks to be removed from the roller with each disk in one piece. In another preferred embodiments the two parts of a disk are made with a tongue in one half and a groove in the mating half to provide structural stability to a disk when the two halves are brought together. Other arrangements may be made that will allow the disks to be removed, including arrangements using hinges of cloth material or even metal hinges positioned to not interfere with the use of the disks. The disks are used for exercise purposes as discussed below.

Figure 5:
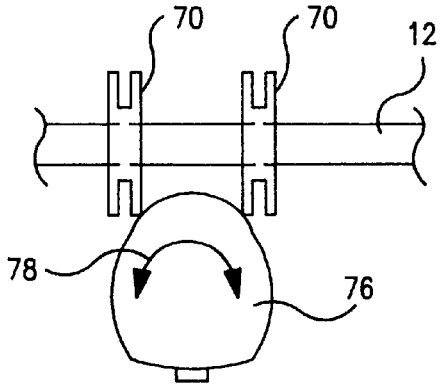
FIG. 5 is a top view of a pair of disks in contact with the user's head.

With reference to FIG. 5, the user's head contacts the disks along the back sides 76 of the user's head. The user then may rotate 78 his head against the disks to exercise the neck and related muscles. In a preferred embodiment the band is a typical belt with holes and a typical belt buckle with a metal arm that fits through a hole to secure the belt, but made to fit the disks. Other types of friction belts and spring action quick disconnect tightening bands, similar to the type shown in FIGS. 2C and 2D, are well known in the art.

The entire apparatus may be anchored to the floor as know in the art.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A passive exercise chair with a passive exercise headrest attached to the chair's back and positioned to accept the back of a user's head comprising:

a seat for accepting a user, a first axle defining a first cylindrical axis substantially perpendicular to the axis of the seated user's backbone, a second axle defining a second cylindrical axis where said second axle is disposed substantially parallel and positioned lower than said first axle first and second rollers slidably mounted on said first and second axles, respectively, means for adjustably attaching said first and said second axles to the back of the chair to accept the back of the user's head, means for adjusting the distance of each axle from the back of the chair, means for adjusting the distance between said axles, and means for creating drag that impedes the rotation of said rollers.

2. The passive exercise chair with a passive exercise headrest as defined in claim 1 further comprising means for adjusting said drag.

3. The passive exercise chair with a passive exercise headrest as defined in claim 1 further comprising means for adjusting the distance between said rollers.

4. The passive exercise chair with a passive exercise headrest as defined in claim 1 further comprising means for changing and securing the lateral position of said first and second rollers with respect to the back of the chair and the user's head.

* * * * *